US012460891B2

(12) United States Patent
Wasilewski et al.

(10) Patent No.: US 12,460,891 B2
(45) Date of Patent: Nov. 4, 2025

(54) BOW CAM HAVING UNIQUE CABLE JOURNALS

(71) Applicants: Donald Wasilewski, Lake Point, UT (US); Brandon Vantassell, Lake Point, UT (US); Cameron Cox, Lake Point, UT (US); David Barnett, Tarpon Springs, FL (US)

(72) Inventors: Donald Wasilewski, Lake Point, UT (US); Brandon Vantassell, Lake Point, UT (US); Cameron Cox, Lake Point, UT (US); David Barnett, Tarpon Springs, FL (US)

(73) Assignee: DAVID A. BARNETT + BARNETT OUTDOORS, LLC, Tarpon Springs, FL (US)

( * ) Notice: Subject to any disclaimer, the term of this patent is extended or adjusted under 35 U.S.C. 154(b) by 339 days.

(21) Appl. No.: 18/210,744

(22) Filed: Jun. 16, 2023

(65) Prior Publication Data

US 2024/0418472 A1 Dec. 19, 2024

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01)

(58) Field of Classification Search
CPC .... F41B 5/10; F41B 5/105; F41B 5/12; F41B 5/123; Y10S 124/90
USPC ..... 124/25, 25.6, 900
See application file for complete search history.

(56) References Cited

U.S. PATENT DOCUMENTS 4,338,910 A * 7/1982 Darlington ..... F41B 5/10 124/900
4,340,025 A * 7/1982 Caldwell ..... F41B 5/105 124/900
4,457,288 A * 7/1984 Ricord ..... F41B 5/10 124/900
4,541,401 A * 9/1985 Caldwell ..... F41B 5/105 124/900
6,474,324 B1 * 11/2002 Despart ..... F41B 5/105 124/25.6
7,578,289 B2 * 8/2009 Norkus ..... F41B 5/10 124/44.5
7,637,256 B2 12/2009 Lee
8,069,848 B1 * 12/2011 Larson ..... F41B 5/10 124/900
8,651,095 B2 * 2/2014 Islas ..... F41B 5/123 124/900
8,833,349 B2 * 9/2014 Park ..... F41B 5/0094 124/25.6
9,354,015 B2 * 5/2016 Yehle ..... F41B 5/10
9,377,267 B1 * 6/2016 Kempf ..... F41B 5/105
9,453,698 B1 * 9/2016 Grace ..... F41B 5/1411
(Continued)

*Primary Examiner* — Alexander R Niconovich
(74) *Attorney, Agent, or Firm* — Donald J. Ersler

(57) ABSTRACT

A cam for an archery bow having flat segmented power cable tracks or journals. The cam preferably includes five stacked journals sharing a common axis. The middle journal receivable for a bowstring with opposing mirrored and segmented cable journals above and below the bowstring journal plane. Alternately, the cam having three stacked journals; a bowstring journal and two segmented cable journals. A bowstring and cable(s) interact with the cam(s) and other components to fire a projectile, such as an arrow.

23 Claims, 15 Drawing Sheets

(56) References Cited

U.S. PATENT DOCUMENTS

| | | | | |
|---|---|---|---|---|
| 9,494,379 | B2 * | 11/2016 | Yehle | F41B 5/10 |
| 9,759,509 | B1 * | 9/2017 | Kempf | F41B 5/123 |
| 9,829,268 | B1 * | 11/2017 | Kempf | F41B 5/105 |
| 9,879,936 | B2 * | 1/2018 | Yehle | F41B 5/105 |
| 10,048,036 | B1 * | 8/2018 | Kempf | F41B 5/105 |
| 10,386,151 | B2 * | 8/2019 | McPherson | F41B 5/10 |
| 10,458,742 | B1 * | 10/2019 | Kempf | F41B 5/123 |
| 10,495,404 | B2 * | 12/2019 | Shaffer | F41B 5/1469 |
| 10,502,516 | B2 * | 12/2019 | Bednar | F41B 5/105 |
| 10,634,447 | B2 * | 4/2020 | Smith | F41B 5/123 |
| 10,969,192 | B1 * | 4/2021 | Gallops, Jr. | F41B 5/123 |
| 10,989,492 | B1 * | 4/2021 | Kempf | F41B 5/105 |
| 11,022,398 | B1 * | 6/2021 | Kempf | F41B 5/105 |
| 11,112,205 | B1 * | 9/2021 | Kempf | F41B 5/123 |
| 11,371,795 | B1 * | 6/2022 | Kempf | F41B 5/105 |
| 11,378,350 | B1 * | 7/2022 | Kempf | F41B 5/123 |
| 11,499,792 | B1 * | 11/2022 | Kempf | F41B 5/105 |
| 11,982,508 | B2 * | 5/2024 | Yehle | F41B 5/105 |
| 2008/0135032 | A1 * | 6/2008 | Islas | F41B 5/10 124/90 |
| 2012/0125302 | A1 * | 5/2012 | Stanziale | F41B 5/123 124/25 |
| 2017/0122691 | A1 * | 5/2017 | Yehle | F41B 5/123 |
| 2025/0244097 | A1 * | 7/2025 | Yehle | F41B 5/143 |

* cited by examiner

BOW CAM HAVING UNIQUE CABLE JOURNALS

CROSS-REFERENCES TO RELATED APPLICATIONS

This is a non-provisional patent application which claims the benefit of patent application No. 63/444,711, filed on Feb. 10, 2023.

BACKGROUND OF THE INVENTION

1. Field of the Invention

The present invention relates generally to archery and more specifically to a shooting bow with a unique cable track arrangement on the cams, which allows a portion of first and/or second cables to slideably transition from a first segment cable journal to a second segment cable journal without excessive wear to the cables. The cam(s) for an archery bow having segmented cable tracks or journals. The cam(s) preferably includes five stacked journals sharing a common axis. The middle journal receivable for a bowstring with opposing mirrored and segmented cable journals above and below the bowstring journal plane. Alternately, the cam(s) having three stacked journals; a bowstring journal and two segmented cable journals. A bowstring and cable(s) interact with the cam(s) and other components to fire a projectile, such as an arrow.

This arrangement enables the device to have self-timing and no cam-lean. The present invention may alternately use components other than flexible limbs for storing energy prior to launching the projectile.

2. Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However, the inefficient use of tensioning devices severely limits the potential of this device. U.S. Pat. No. 8,651,095 to Islas discloses a bowstring cam arrangement for compound crossbow, which provides a method of removing the cables from the path of the string.

There are many prior art examples of cams having helical cable tracks or journals. U.S. Pat. Nos. 4,340,025 and 4,541,401 Caldwell disclose the use of "grooves that are substantially helical". U.S. Pat. No. 7,578,289 issued to Norkus discloses "grooves 30 for the cables 24 and 26 are helical in shape and also have the capacity for two full wraps", in other words the helical cable journals that may allow up to 720 degrees of rotation.

US Publication 2012/0312287 Park disclose several versions of cams with helical structures, as does US 2102/0125302 Stanziale.

U.S. Pat. No. 9,354,015 ('015 Yehle); U.S. Pat. No. 9,494,379 ('379 Yehle); and U.S. Pat. No. 9,879,936 ('936 Yehle) claim the use of helical cable journals as novel, though the prior art of Norkus and Caldwell disprove this claim. Patent '015 Yehle discloses a reverse draw crossbow with helical cable journals, and '379 Yehle and '936 Yehle to disclose a crossbow that relies on four cables and helical cable journals, however issues are created by having separate cables above and below the string track on each cam, as well as confining the cables or string to a helical track or journal. The cable journal itself can be detrimental to the longevity of the cables. The structural shape of the journal is generally "U" shaped, and usually less than 100 percent the diameter of the cable in depth. Though the outer edges of the journals are broken as much as possible with a radius or a fillet, the edges still cause friction and create wear on the cables as the cables wrap the journals. A cam having a single plane-flat-track journal will have little cable wear as the cable wraps into the journal without excessive contact with the journal edge, and is generally acceptable. This is not the case with a true helical cable journal due to the path of the cable and the forces applied to the cable as the cable is wrapped into the helical journal. Angular pressures are applied to the cable as the cable is forced to climb the helix, the greatest amount of pressure (friction) where the cable engages the edge of the helical cable journal as it wraps, causing the cables to wear out prematurely. Due to manufacturing restraints and machining capabilities, little can be done to reduce this friction and wear.

Further, if the cables of '379 Yehle and '936 Yehle are not of exact length, or if the upper cable stretches more than the lower cable, or visa-versa, the cables must be adjusted by the user to stay in "time" with each other. Timing of the cables can be a laboriously difficult process. Additionally, there are serious limitations to the desirable mechanical efficiencies and characteristics related to the draw-force curve and usability of a shooting bow with cams having continuous helical cable journals.

U.S. Pat. No. 9,759,509 to Kempf teaches a cable configuration wherein there is only one cable per side, and the cables are not anchored to the cams, which allows for self-timing. U.S. Pat. No. 11,022,398 to Kempf discloses one cable per side, having the cable ends anchored to the cams, and a mid-segment transitions the cables from above the bowstring to below the bowstring via a pulley type component.

Accordingly, there is a clearly felt need in the art to provide a cam for a shooting bow, which allows segments of the cables to be slide-ably engage-able with a first and second cam, on a first upper and lower and a second upper and lower cable engagement portions, and the ends of the cables may be coupled adjacent the center-line of the shooting bow, or coupled to the same cam, respectively, wherein the cams are allowed to rotate at least 200 degrees, up to at least 360 degrees, and the cams having flat power cable journals that reduce associated wear and allow for more desirable mechanical draw-force characteristics. From a manufacturing standpoint, a flat journal is easier, thus more economical, to machine than a helical journal.

SUMMARY OF THE INVENTION

The present invention provides a self-timing cam string and cable configuration for a projectile launching device. The present invention preferably includes a pair of cables, wherein both ends of the same cable preferably anchor to the same cam(s) or anchor adjacent the center line of the crossbow. The projectile launching device with self-timing and without cam lean may be applied to either a crossbow or vertical bow, however hereinafter will be mostly be referred to as "crossbow." In a first preferred embodiment, a bow preferably includes a first cam, a second cam, a bowstring and one or two cables, collectively known as a harness system. Preferably, the first and second cables do not cross a centerline of the shooting bow.

In a second preferred embodiment, a crossbow preferably includes all generally known components of a crossbow, such as a string latch housing, a bow riser, a rail, a first energy storing device (such as a first flexible limb), a second energy storing device (such as a second flexible limb), a first cam, a second cam, a bowstring, and one or two cables.

START Below:

The term "limb" may refer to what are known as solid limbs, split-limbs, tube-limbs, or any other flexible energy storing component. The bow riser is coupled with the rail. One end of the first limb is coupled to, and extends from, a first end of the bow riser and one end of the second limb is coupled to, and extends from, a second end of the bow riser. The first cam is pivotally retained on the first limb and the second cam is pivotally retained on the second limb. During operation, the limbs generally move on an arc, and the cams move with the limbs.

"C1" is the first cam.

"C2" is the second cam.

Segmented journal "J1" is on plane 1 "P1"

Segmented journal "J2" is on plane 2 "P2"

Segmented journal "J3" is on plane 2 "P3"

Segmented journal "J4" is on plane 2 "P4"

Segmented journal "J5" is on plane 2 "P5"

The planes are parallel to each other.

The journals share a common axis of rotation.

Transition zone one and two have no journal surfaces.

It has been generally accepted in the industry that a "journal" is defined as a structure that retains a bowstring or power cable, and usually is "U" or "V" shaped. This journal extends radially about what we will call a "barrel". The barrel is the perimetrical shape of the string journal or cable journal, without the confines of the journal walls (radial extensions). Radial extensions create the perimeter retainments for the bowstring or cable. Without these radial extensions the string or cables would not follow the exact same rotational path each time, or they may slide off of the barrel.

In the preferred embodiment, the first and second cams includes five separate stacked journals that share the same axis of rotation, and the five journals on each cam are more or less parallel to each other. Further, the five journals of the first cam and the five journals of the second cam are all co-planer, that is to say the bowstring plane of the first cam is co-planer to the bowstring journal of the second cam and so on. The center journals (journals cam 1 journal 3 (C1J3) and cam 2 journal 3 (C2J3)) receive the bowstring. The first cam having two separate segmented journals above the string journal C1-J1/J2, and two separate segmented journals below the string journal C1-J4/J5. A transition zone is adjacent the terminal end of J2 and the leading edge of J1, and is part of the power cable barrel. This transitions zone has is a smooth radial surface, that is to say it has no radial extensions, perpendicular to the plane of rotation of the bowstring journals. The second cam having two separate segmented journals above the string journal C2-J1/J2, and two separate segmented journals below the string journal C2-J4/J5. A transition zone is adjacent the terminal end of J2 and the leading edge of J1, and is part of the power cable barrel. This transitions zone has a smooth radial surface, that is to say it has no radial extensions, perpendicular to the plane of the bowstring journals. A first end of the bowstring is retained by the first cam and a second end of the bowstring is retained by the second cam.

In a preferred embodiment, a first upper cable post is located on or near the plane of P1, and a lower cable post is located on or near P5 on a first side of the longitudinal centerline of the crossbow, and a second upper cable post is located on or near P1, and a second cable post is located on or near P5 on a second side of the longitudinal centerline of the crossbow.

The first cam C1 Journal 2 C1-J2 is on a plane above the bowstring journal C1-J3, and the first cam C1 Journal J1 is on a plane above C1-J2. Journal J2 may extend around the perimeter of the first cable first cable-path as little as 20 degrees of rotation and preferably no more than two hundred degrees of rotation. Cam 1 transition zone one is adjacent the terminal end of C1-J2, and may extend around the perimeter of the first cable first cable-path as little as forty five degrees, and no more than two hundred degrees of rotation. The terminal end of the C1 transition zone one is adjacent the leading edge of the C1-J1 Journal. Journal 1 J1 may extend around the perimeter of the first cable first cable-path as little as twenty degrees but preferably no more than two hundred degrees of rotation.

The first cam C1 Journal 4 C1-J4 is on a plane below the bowstring journal C1-J3, and the C1-J5 is on a plane below C1-J4, and C1-J4 and C1-J5 are a mirror image of C1-J2 and C1-J1. Journal J4 may extend around the perimeter of the first cable second cable-path as little as 20 degrees of rotation and preferably no more than two hundred degrees of rotation. Cam 1 transition zone two is adjacent the terminal end of C1-J4, and may extend around the perimeter of the first cable second cable-path as little as forty five degrees, and preferably no more than two hundred degrees of rotation. The terminal end of the C1 transition zone two is adjacent the leading edge of the C1-J5 Journal. Journal 5 J5 may extend around the perimeter of the first cable second cable-path as little as twenty degrees but no more than two hundred degrees of rotation.

The first cable cable-path one and cable-path two of Cam 1 are mirror images of each other about the plane of C1-J3. Each of the cable paths has three distinct segments: a first segment that is retained within a first/fourth flat journal; a second segment that is not retained in any journal; and a third segment that is retained in first/fifth flat journal.

The second cam C2 Journal 2 C2-J2 is on a plane above the bowstring journal C2-J3, and the second cam C2 Journal J1 is on a plane above C2-J2. Journal J2 may extend around the perimeter of the second cable first cable-path as little as 20 degrees of rotation and preferably no more than two hundred degrees of rotation. Cam 2 transition zone one is adjacent the terminal end of C2-J2, and may extend around the perimeter of the second cable first cable-path as little as forty five degrees, and preferably no more than two hundred degrees of rotation. The terminal end of the C2 transition zone one is adjacent the leading edge of the C2-J1 Journal. Journal 1 C2-J1 may extend around the perimeter of the second cable first cable-path as little as twenty degrees but no more than two hundred degrees of rotation.

The second cam C2 Journal 4 C2-J4 is on a plane below the bowstring journal C2-J3, and the second cam C2 Journal J5 is on a plane below C2-J4. Journal C2-J4 may extend around the perimeter of the second cable second cable-path as little as 20 degrees of rotation and preferably no more than two hundred degrees of rotation. Cam 2 transition zone two is adjacent the terminal end of C2-J4, and may extend around the perimeter of the second cable second cable-path as little as forty-five degrees, and preferably no more than two hundred degrees of rotation. The terminal end of the C2 transition zone two is adjacent the leading edge of the C2-J5 Journal. Journal 5 C2-J5 may extend around the perimeter of the second cable second cable-path as little as twenty degrees but preferably no more than two hundred degrees of rotation.

The second cable cable-path one and cable-path two of Cam 2 are mirror images of each other about the plane of C2-J3. Each of the cable paths have three distinct segments: a first segment that is retained within a first flat journal; a second segment that is not retained in any journal; and a third segment that is retained in second flat journal.

In a preferred embodiment, the first and second ends of the first and second cables are coupled to the crossbow near the longitudinal centerline of the crossbow without crossing it. The first ends of the cables are preferably coupled at a vertical displacement more or less on the plane of C1-J1 and C2-J1; the second ends of the first and second cables are preferably coupled at a vertical displacement more or less on the plane C1-J5 and C2-J5.

The center of the first cable is retained in first cam, and the center of the second cable is retained in the second cam. When the crossbow is at rest, or in the released configuration, cable segments adjacent the middle of the first and second cables above C1-J3 and C2-J3 may be engaged with a portion of C1-J2 and C2-J2, and cable segments adjacent the middle of the first and second cables below C1-J3 and C2-J3 may be engaged with a portion of C1-J4 and C2-J4. At this orientation, the first and second cables depart the cams at an angle due to the position of the cable ends. As the bowstring is drawn, the bowstring unwinds or is let out from C1-J3 and C2-J3, and the first and second cables wind or are taken up C1-J2/J4 and C2-J2/J4. With continued rotation of the cams, as the cables segments reach the terminal ends of J2/J4, the angular pressure created by the vertical disposition of the cables ends versus the departure point of the cables on the cable paths biases the cables into J1/J5 of the first and second cams.

As the bowstring continues to be drawn and let out of C1-J3 and C2-J3, the cable segments continue to wind in C1-J1/J5 and C2-J1/J5.

In a preferred embodiment, the first and second cams have a ramp adjacent the transition zones to transition the cable segments from J2/J4 into J1/J5 during rotation of the cams. The ramp may be a feature manufactured with the cam body, or may be separate components coupled with the cam body.

In an alternate embodiment, the first and second cams includes three separate journals that share the same axis of rotation, and the three journals on each cam are more or less parallel to each other. The third journals C1-J3 and C2-J3 receive the bowstring. Further, the three journals of the first cam and the three journals of the second cam are all co-planer, that is to say the bowstring plane of the first cam is co-planer to the bowstring journal of the second cam and so on. The first cam having two segmented journals above the string journal C1-J1/J2. A transition zone is adjacent the terminal end of J2 and the leading edge of J1. This transitions zone has a smooth radial surface perpendicular to the plane of rotation of the C1-J3. The second cam having two segmented journals above the string journal C2-J1/J2. A transition zone is adjacent the terminal end of J2 and the leading edge of J1. This transitions zone has a smooth radial surface perpendicular to the plane of rotation of C2-J3. A first end of the bowstring is retained by the first cam and a second end of the bowstring is retained by the second cam. In a preferred embodiment, a first set of first and second cable posts are located on the cam near the plane of the bowstring, and the second set of first and second cable posts are located below the plane of the bowstring.

The first cam C1 Journal 2 C1-J2 is on a plane below the bowstring journal C1-J3, and the first cam C1 Journal J1 is on a plane below C1-J2. J2 may extend around the perimeter of the first cable path as little as 20 degrees of rotation and preferably no more than two hundred degrees of rotation. Cam 1 transition zone one is adjacent the terminal end of C1-J2, and may extend around the perimeter of the first cable path as little as forty five degrees, and preferably no more than two hundred degrees of rotation. The terminal end of the C1 transition zone one is adjacent the leading edge of the C1-J1 Journal. J1 may extend around the perimeter of the first cable path as little as twenty degrees but preferably no more than two hundred degrees of rotation.

C2-J2 is on a plane below the bowstring journal C2-J3, and C2-J1 is on a plane below C2-J2. Journal J2 may extend around the perimeter of the second cable path as little as 20 degrees of rotation and preferably no more than two hundred degrees of rotation. Cam 2 transition zone one is adjacent the terminal end of C2-J2, and may extend around the perimeter of the second cable path as little as forty five degrees, and preferably no more than two hundred degrees of rotation. The terminal end of the C2 transition zone one is adjacent the leading edge of C2-J1. Journal C2-J1 may extend around the perimeter of the second cable path as little as twenty degrees but preferably no more than two hundred degrees of rotation.

The first cable path of Cam 1 and the second cable path of Cam 2 are mirror images of each other about the longitudinal center-line of the crossbow.

In a preferred alternate embodiment, the second ends of the first and second cables are coupled to the crossbow near the center of the crossbow without crossing the longitudinal center line of the crossbow. The first ends of the cables are preferably coupled to the cams at a vertical displacement more or less on the plane of C1-J3 and C2-J3; the second ends of the first and second cables are preferably coupled at a vertical displacement more or less on the plane C1-J1 and C2-J1.

When the crossbow is at rest, or in the released configuration, cable segments adjacent the middle of the first and second cables below C1-J3 and C2-J3 may be engaged with a portion of C1-J2 and C2-J2. At this orientation, the first and second cables depart the cams at an angle due to the position of the second cable ends. As the bowstring is drawn, the bowstring unwinds or is let out from C1-J3 and C2-J3, and the first and second cables wind or are taken up C1-J2 and C2-J2. With continued rotation of the cams, as the cables segments reach the terminal ends of C1-J2 and C2-J2, the angular pressure created by the vertical disposition of the cables ends versus the departure point of the cables on the cable paths biases the cables into J1 of the first and second cams.

As the bowstring continues to be drawn and let out of C1-J3 and C2-J3, the cable segments continue to wind in C1-J1 and C2-J1.

In a preferred alternate embodiment, the first and second cams have a ramp adjacent the transition zones to transition the cable segments from J2 into J1 during rotation of the cams. The ramp may be a feature manufactured with the cam body, or may be separate components coupled with the cam body. The method of manufacture and the composition of the ramp may be of any known that will allow the ramp to perform as desired.

In another alternate embodiment, the cable ends and mid-segment may be coupled with the cams and crossbow frame as disclosed by Kempf '398.

DETAILED DESCRIPTION OF THE DISCLOSURE

Figure 1:
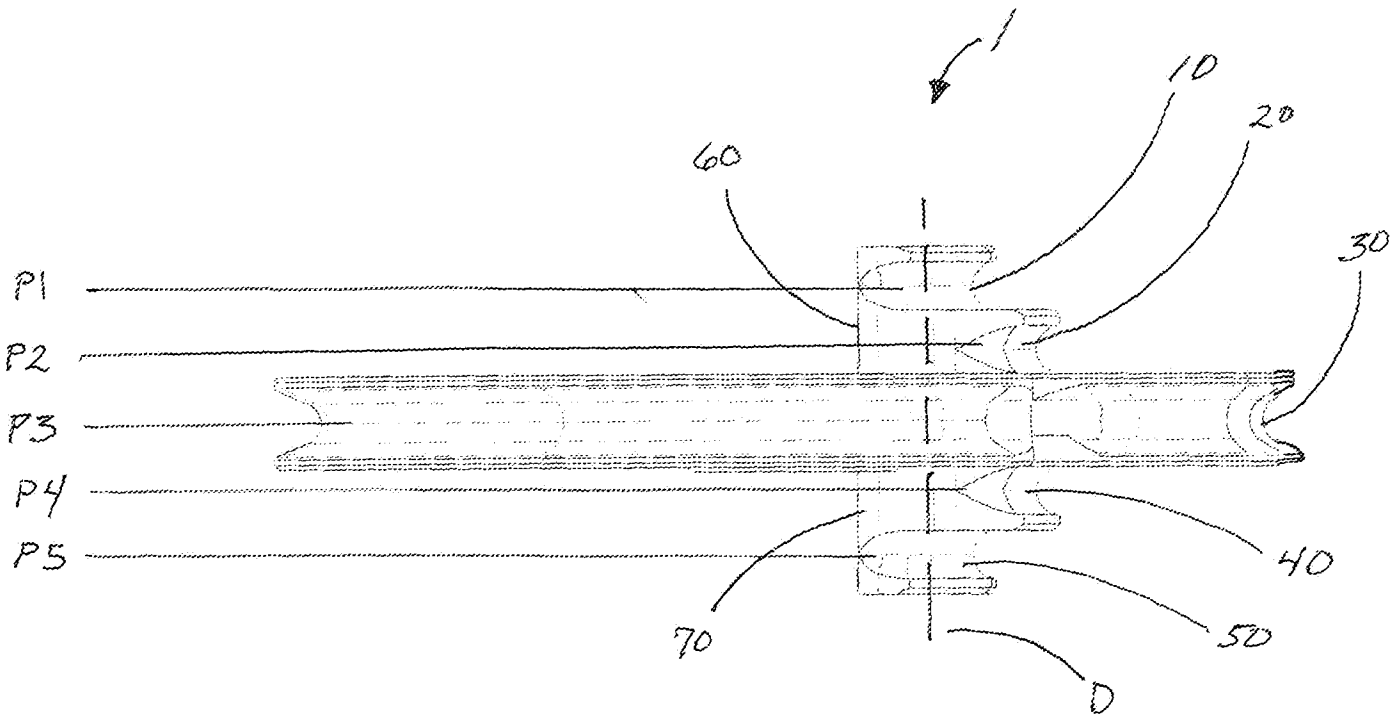
FIG. 1 is a side view of an embodiment of a cam having five parallel journals rotating on a common axis in accordance with the current disclosure.
Figure 2:
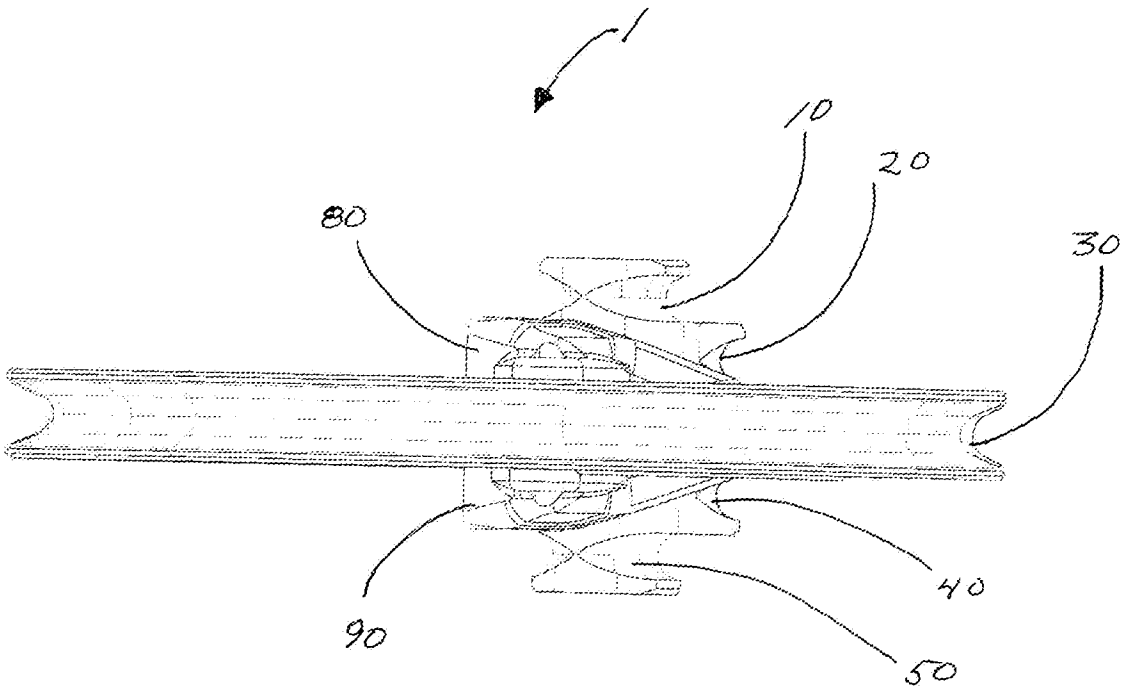
FIG. 2 is a side view of an embodiment of a cam having five parallel journals rotating on a common axis and a ramp in accordance with the current disclosure.
Figure 3:
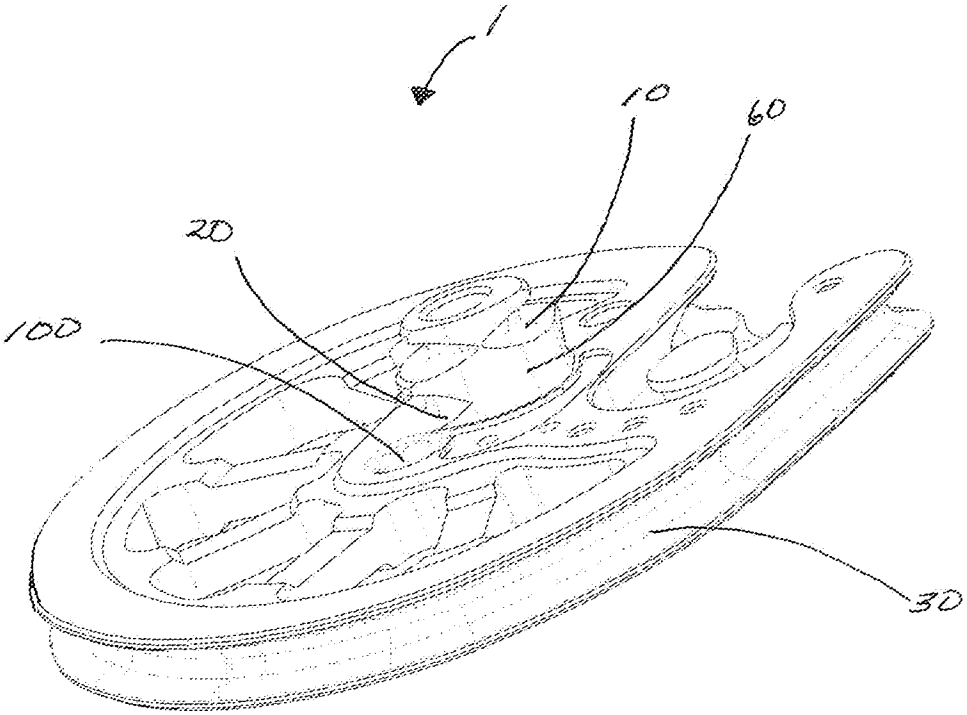
FIG. 3 is a perspective view of an embodiment of a cam having five parallel journals rotating on a common axis in accordance with the current disclosure.
Figure 4:
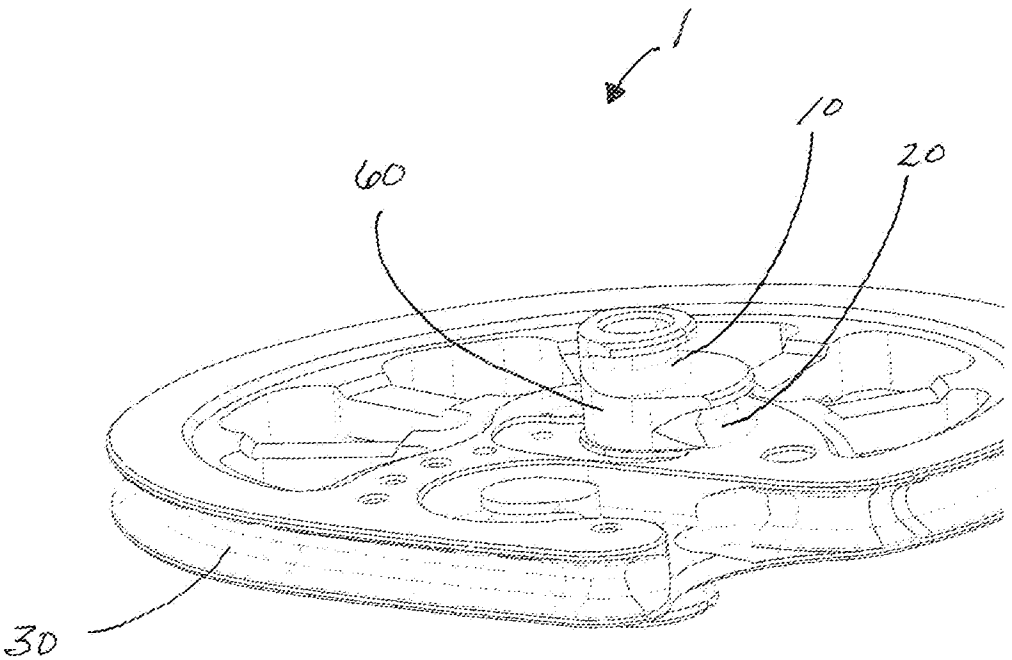
FIG. 4 is a perspective view of an embodiment of a cam having five parallel journals rotating on a common axis in accordance with the current disclosure.
Figure 5:
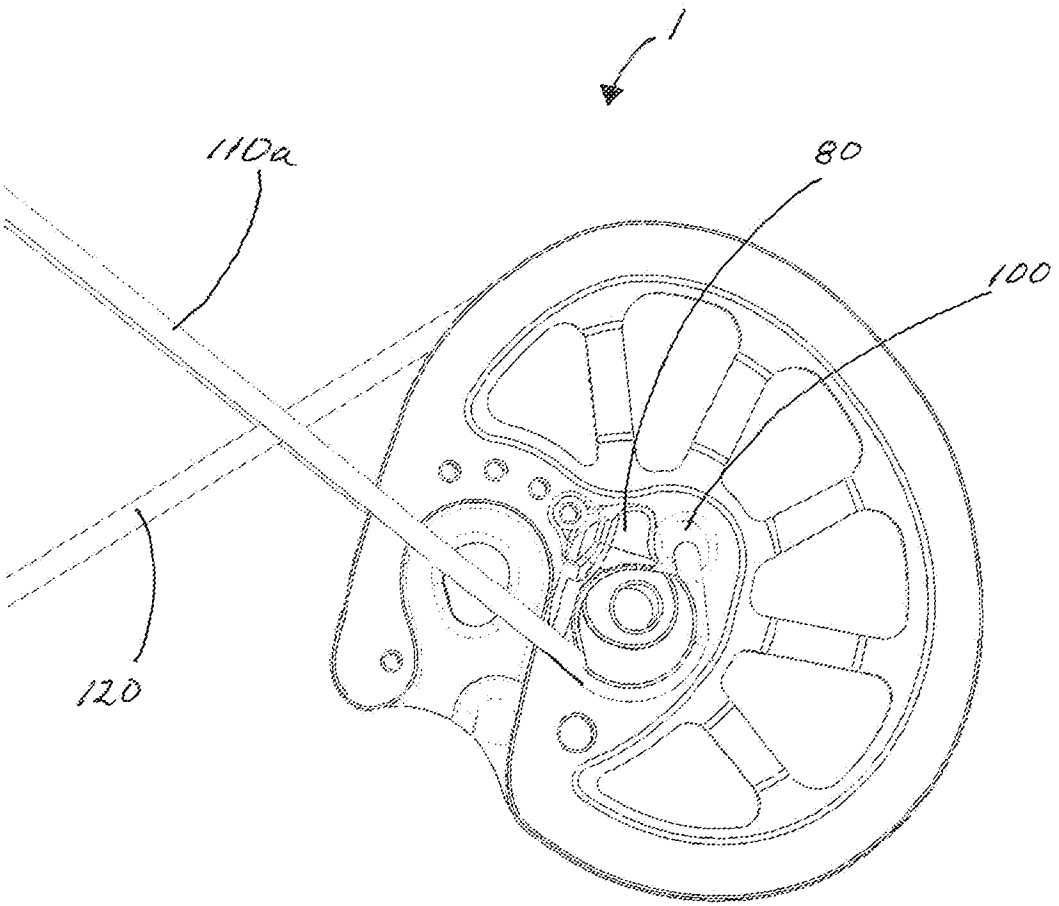
FIG. 5 is a top view of an embodiment of a cam having five parallel journals rotating on a common axis, with a ramp, and a power cable and bowstring in a partially drawn configuration in accordance with the current disclosure.
Figure 6:
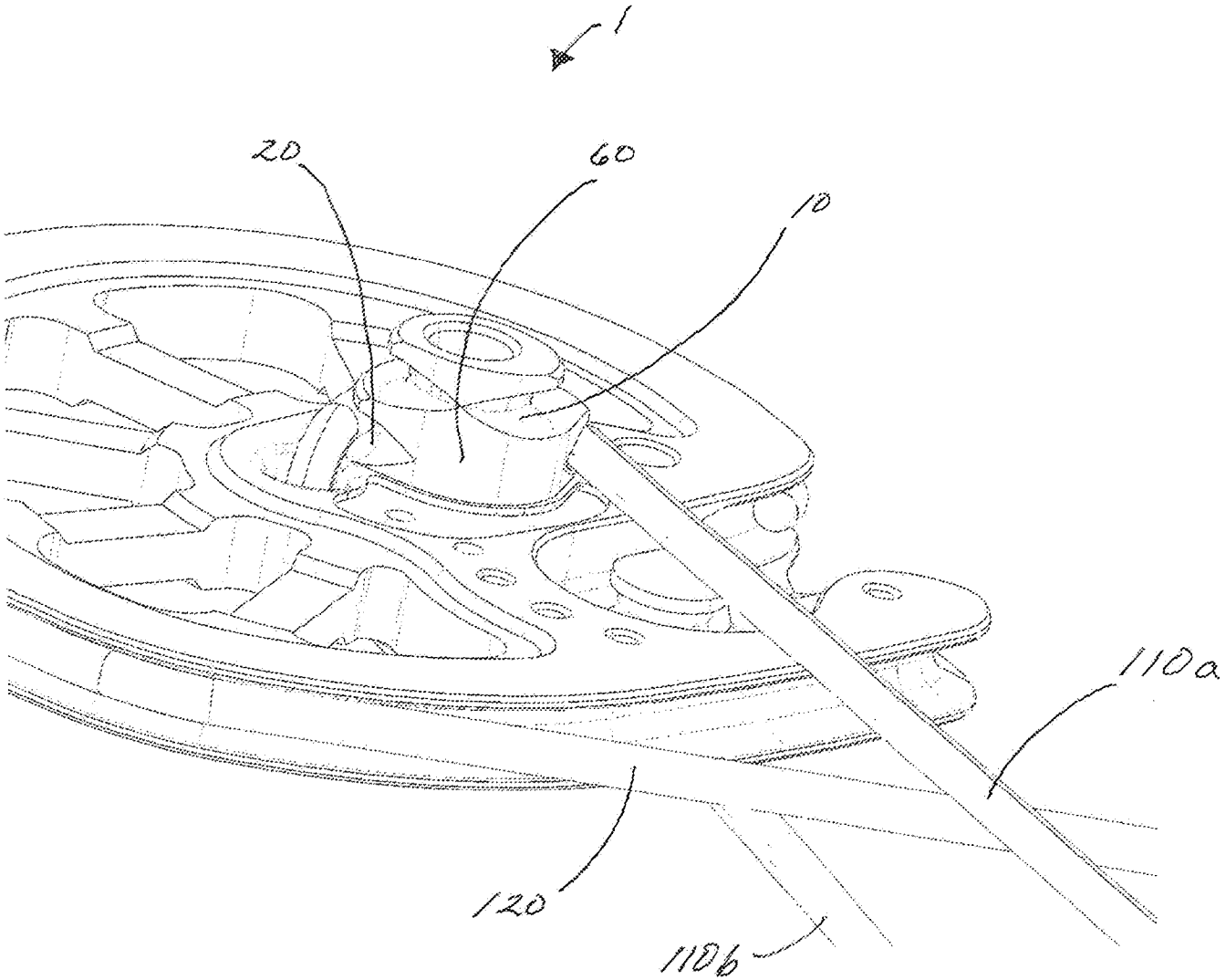
FIG. 6 is a perspective view of an embodiment of a cam having five parallel journals rotating on a common axis, with no ramp, and a power cable and bowstring in a partially drawn configuration prior to the cable engagement with the transition zone in accordance with the current disclosure.
Figure 7:
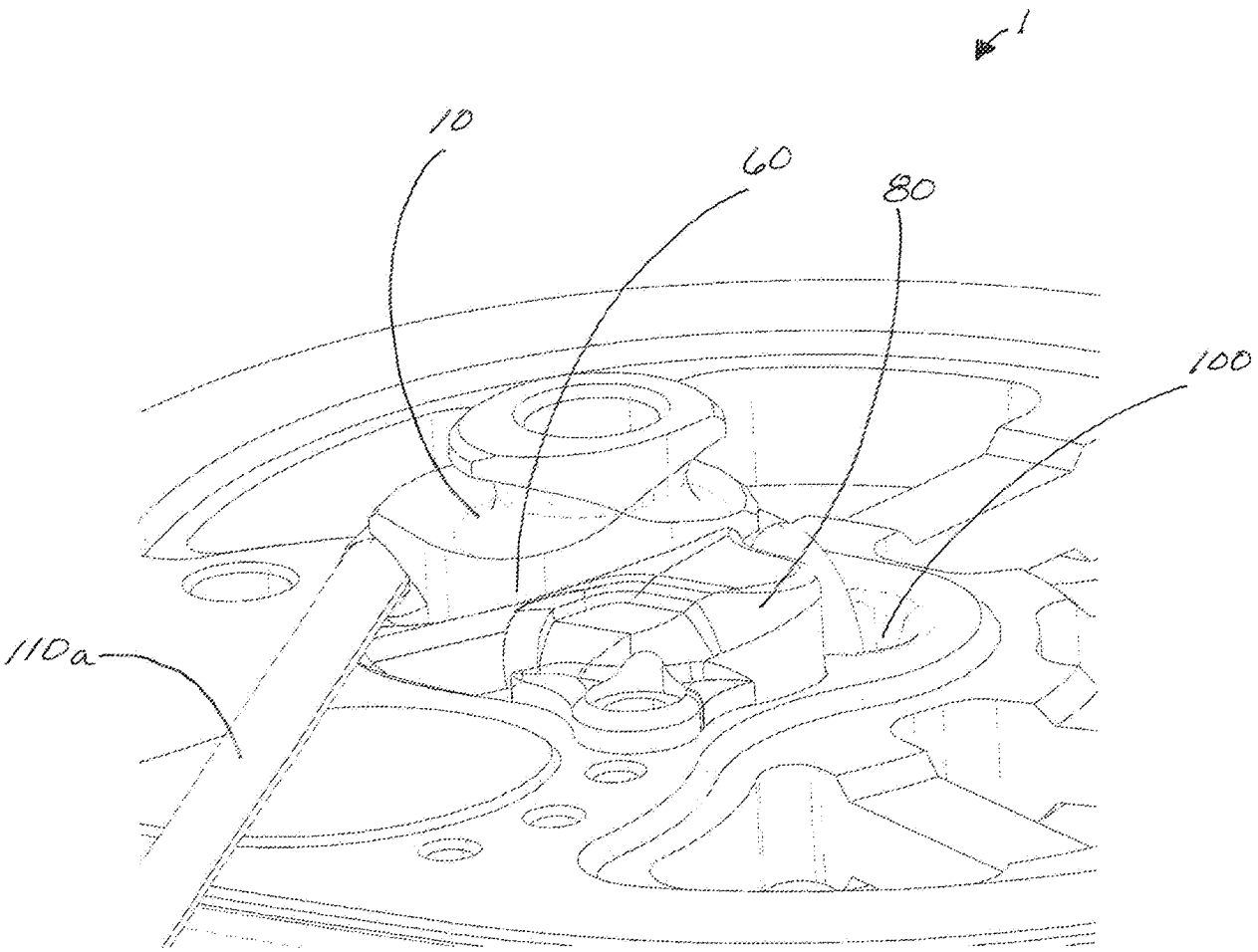
FIG. 7 is a perspective view of an embodiment of a cam having five parallel journals rotating on a common axis, with a ramp, and a power cable and bowstring in a partially drawn configuration prior to the cable engagement with the transition zone in accordance with the current disclosure.

Referencing FIGS. 1 to 4, the first cam 1 and second cam (not shown, as to is a mirror image of the first cam) includes five separate stacked journals that share the same axis of rotation D, and the five journals on each cam are more or less parallel to each other, each journal has a plane and these planes may be referenced by P1, P2, P3, P4, and P5. Further, the five journals of the first cam 1 and the five journals of the second cam are all co-planer, that is to say the bowstring journal C1-J3 of the first cam is co-planer to the bowstring journal C2-J3 of the second cam (Plane P3) and so on. The center journals (journals cam 1 journal 3 (C1-J3) and cam 2 journal 3 (C2-J3)) receive the bowstring. The first cam 1 having two separate segmented journals C1-J1/J2 above the string journal C1-J3, and two separate segmented journals C1-J4/J5 below the string journal C1-J3. Transition zone one 60 is adjacent the terminal end of J2 and the leading edge of J1, and transition zone two 70 is adjacent the terminal end of J4 and the leading edge of J5. Transition zones 60 and 70 have is a smooth radial surface perpendicular to the plane P1 of rotation of the bowstring journals C1-J3.

The second cam may be a mirror image of the first cam 1; a functional mirror image of the first cam 1; or the same as the first cam 1, rotated one hundred eighty degrees top to bottom for proper function.

Figure 8:
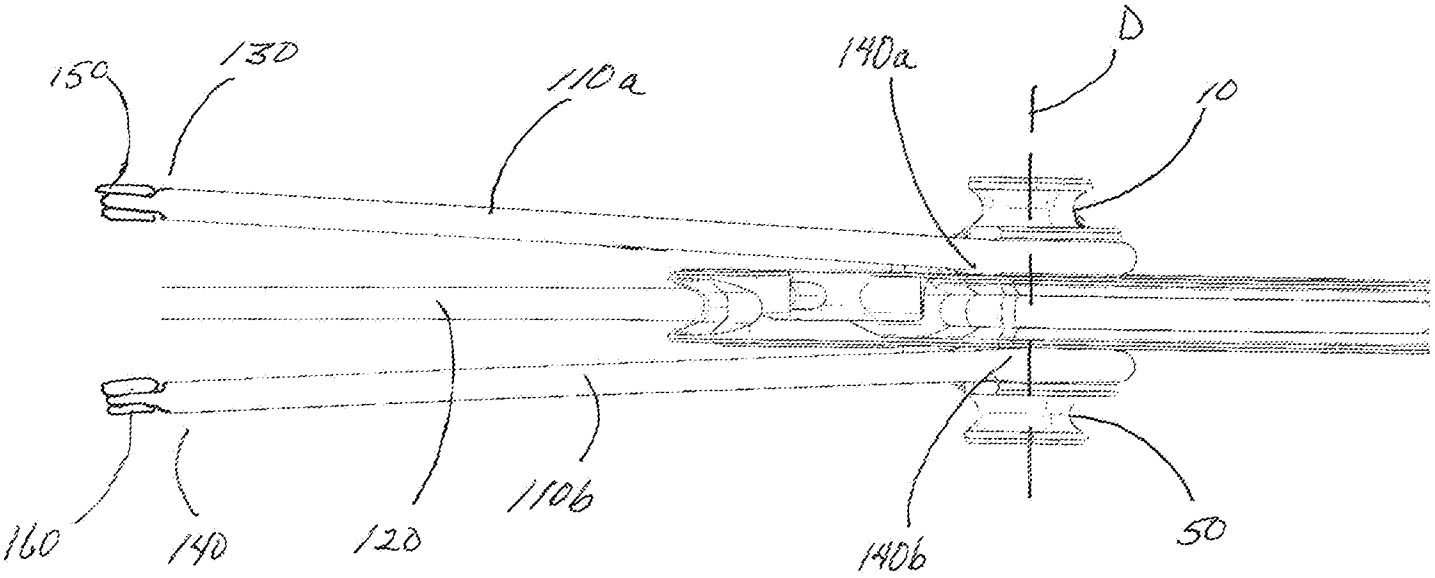
FIG. 8 is a side view of an embodiment of a cam having five parallel journals rotating on a common axis, with no ramp, and a power cable and bowstring in a partially drawn configuration prior to the cable engagement with the transition zone in accordance with the current disclosure.
Figure 9:
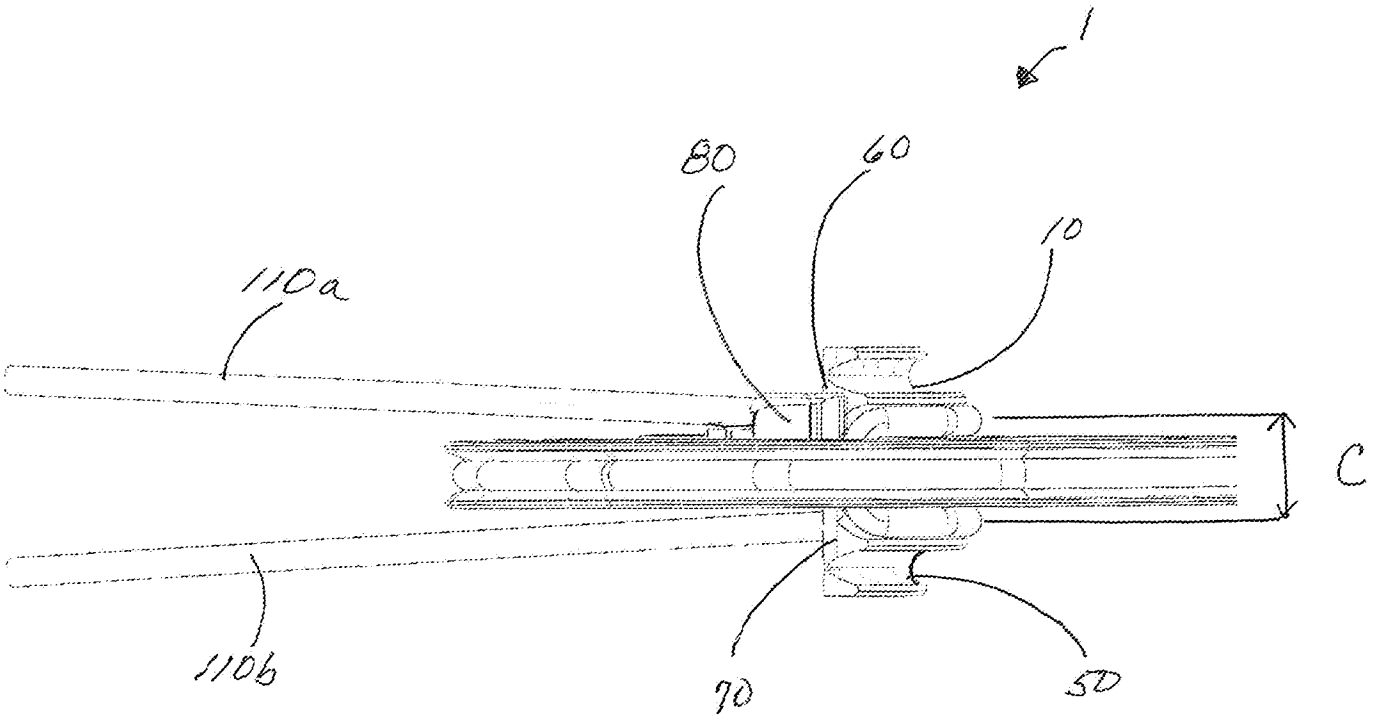
FIG. 9 is a side perspective of an embodiment of a cam having five parallel journals rotating on a common axis, with a ramp, and a power cable and bowstring in a partially drawn configuration prior to the cable engagement with the transition zone in accordance with the current disclosure.
Figure 10:
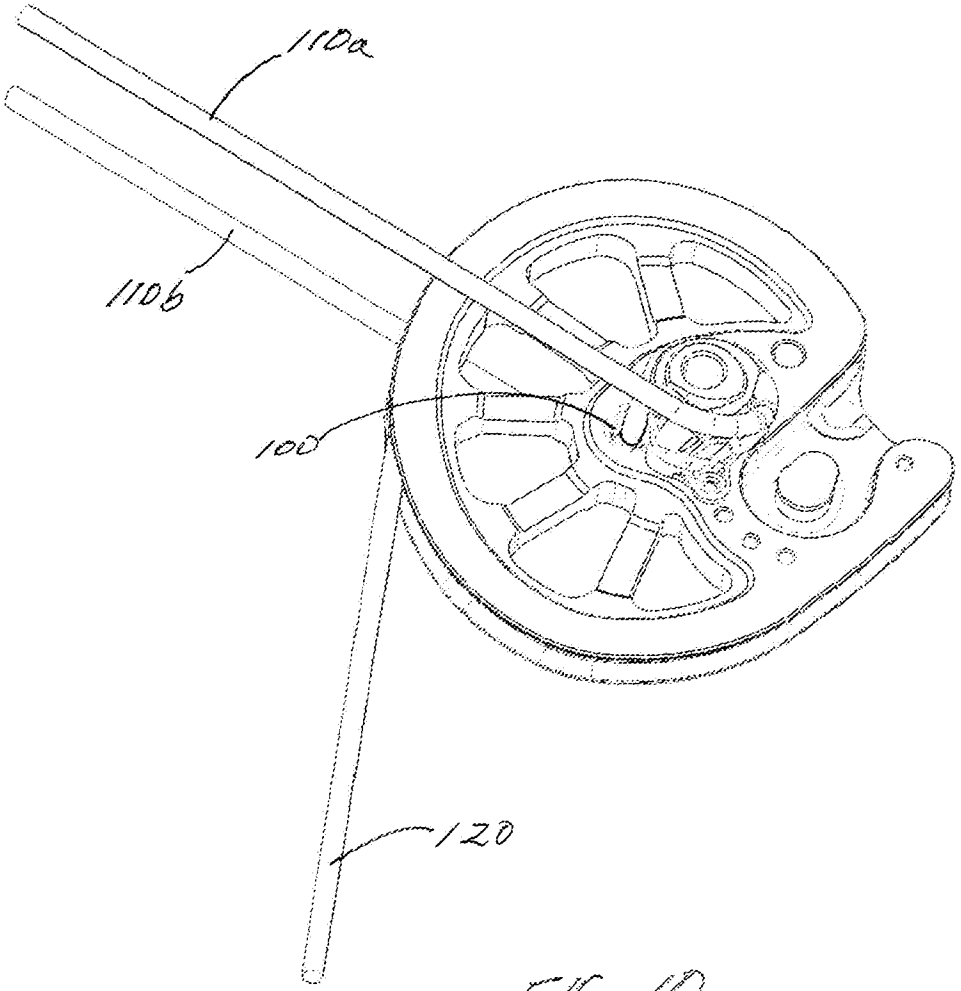
FIG. 10 is a perspective view of an embodiment of a cam having five parallel journals rotating on a common axis, with a ramp, and a power cable and bowstring in a partially drawn configuration, cable segments in the transition zone prior to the cable engagement with the first journal in accordance with the current disclosure.
Figure 11:
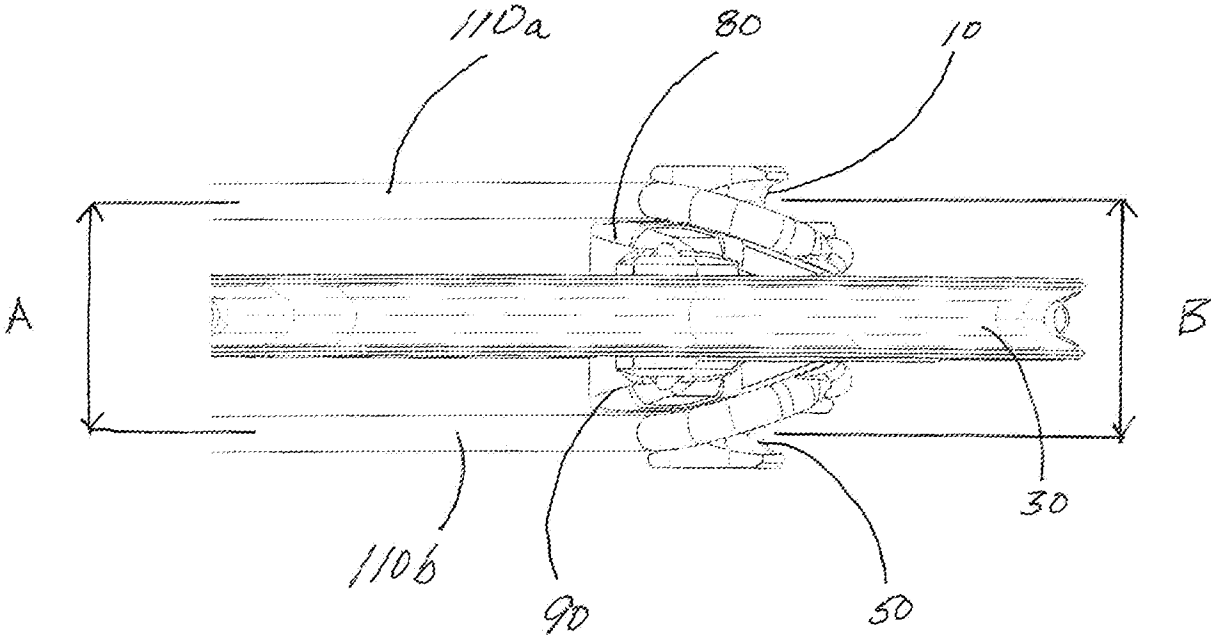
FIG. 11 is a side view of an embodiment of a cam having five parallel journals rotating on a common axis, with a ramp, and a power cable and bowstring in a partially drawn configuration, cable segments in the transition zone prior to the cable segments engagement with the first and fifth journals in accordance with the current disclosure.
Figure 12:
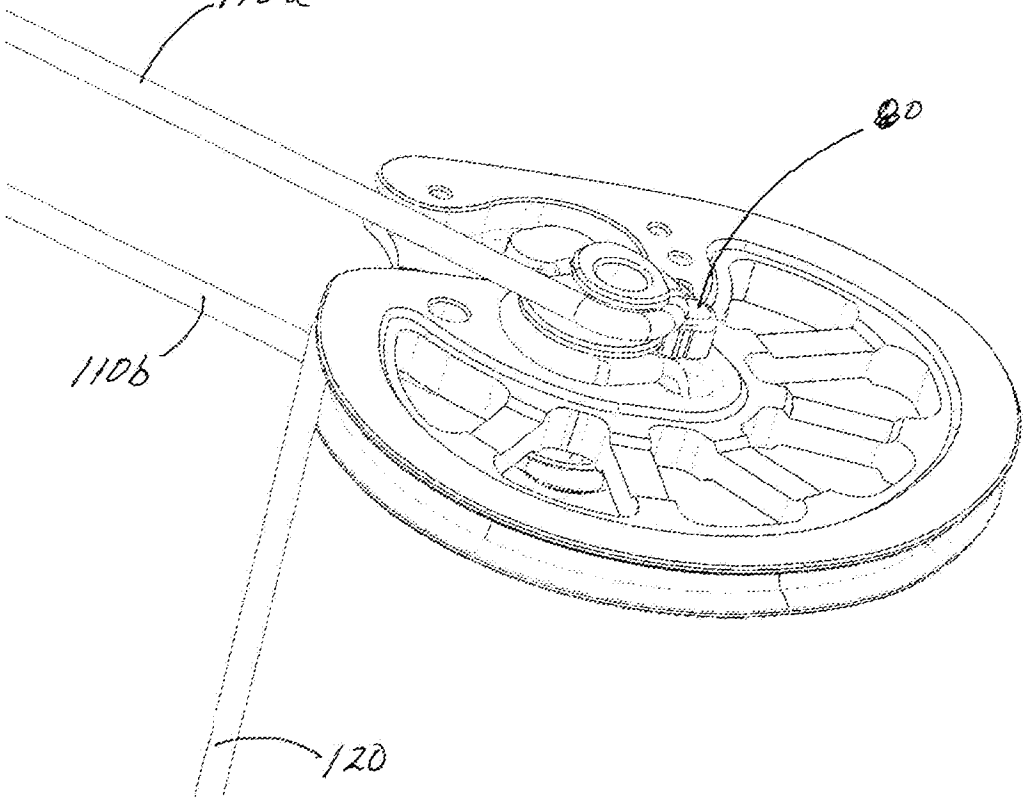
FIG. 12 is a perspective view of an embodiment of a cam having five parallel journals rotating on a common axis, with a ramp, and a power cable and bowstring in a partially drawn configuration wherein the cable segments have engaged with the first and fifth journals in accordance with the current disclosure.
Figure 13:
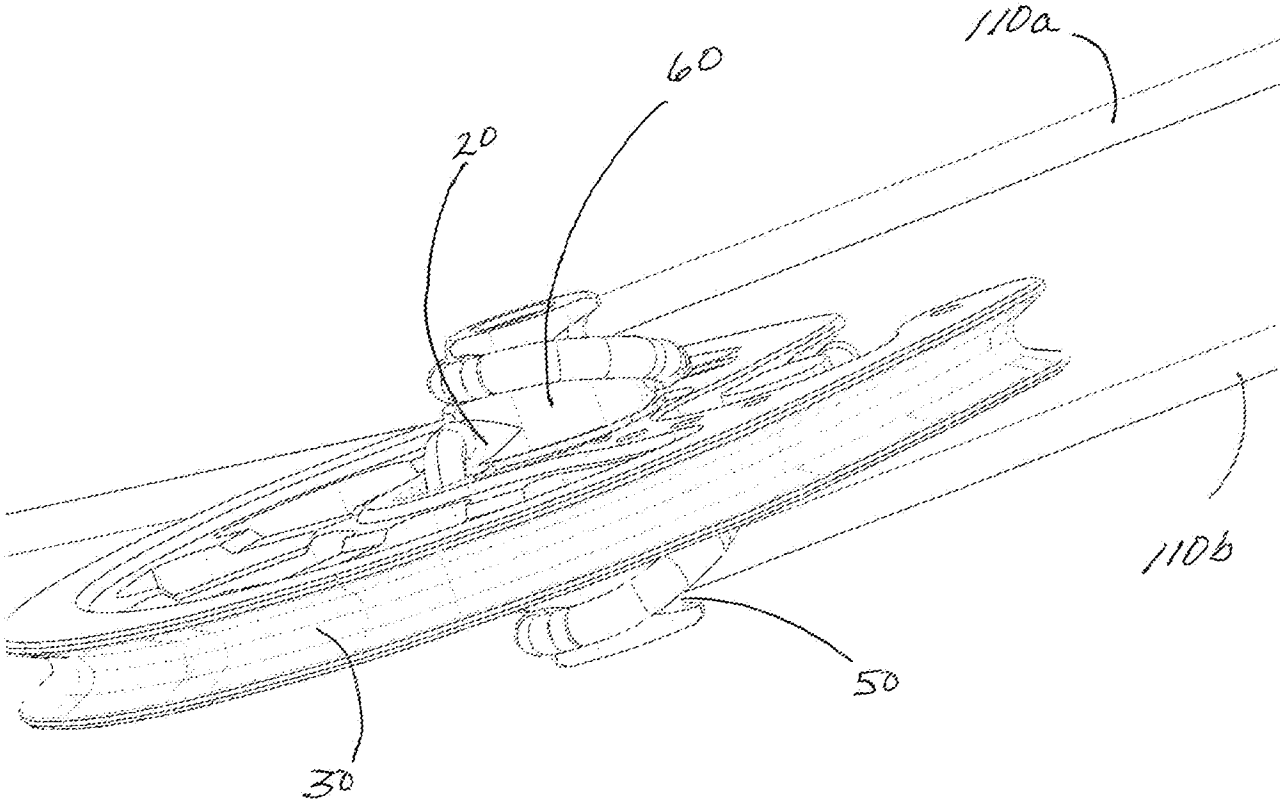
FIG. 13 is a perspective view of an embodiment of a cam having five parallel journals rotating on a common axis, with no ramp, and a power cable and bowstring in a partially drawn configuration wherein the cable segments have engaged with the first and fifth journals in accordance with the current disclosure.
Figure 14:
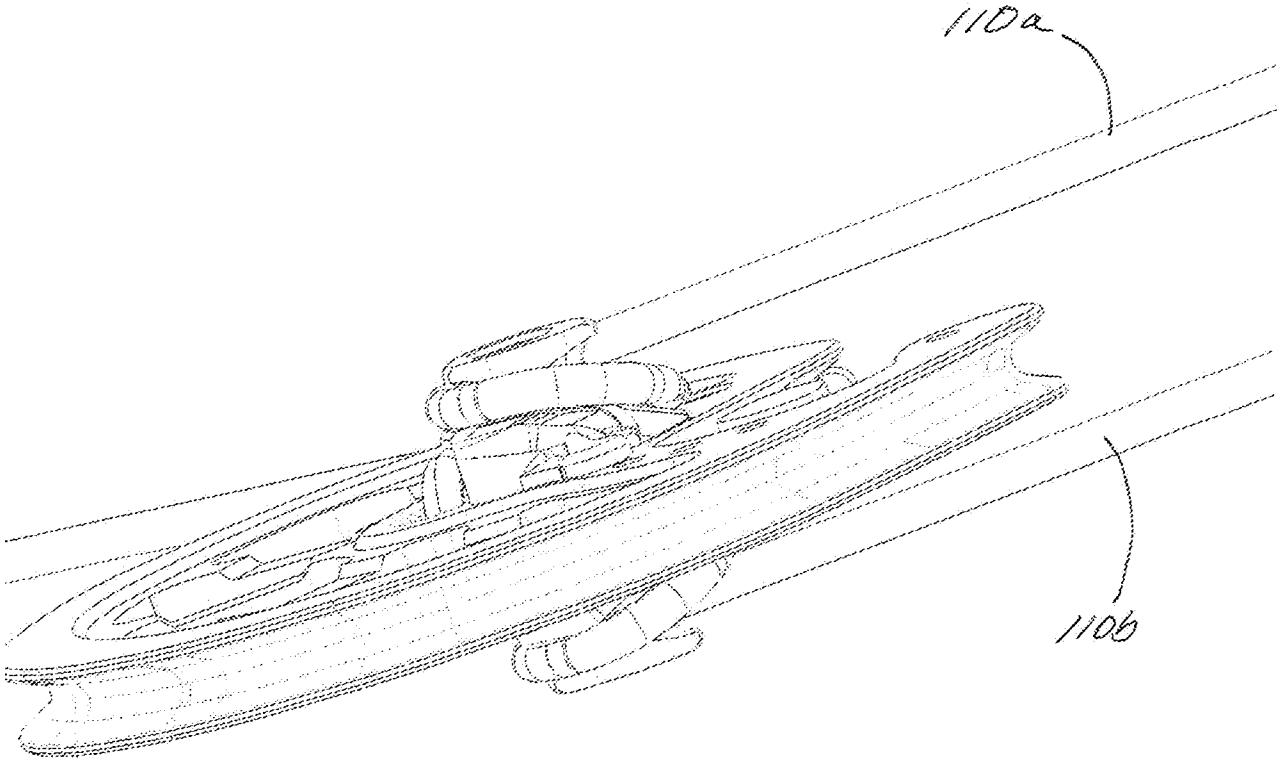
FIG. 14 is a perspective view of an embodiment of a cam having five parallel journals rotating on a common axis, with a ramp, and a power cable and bowstring in a partially drawn configuration wherein the cable segments have engaged with the first and fifth journals in accordance with the current disclosure.
Figure 15:
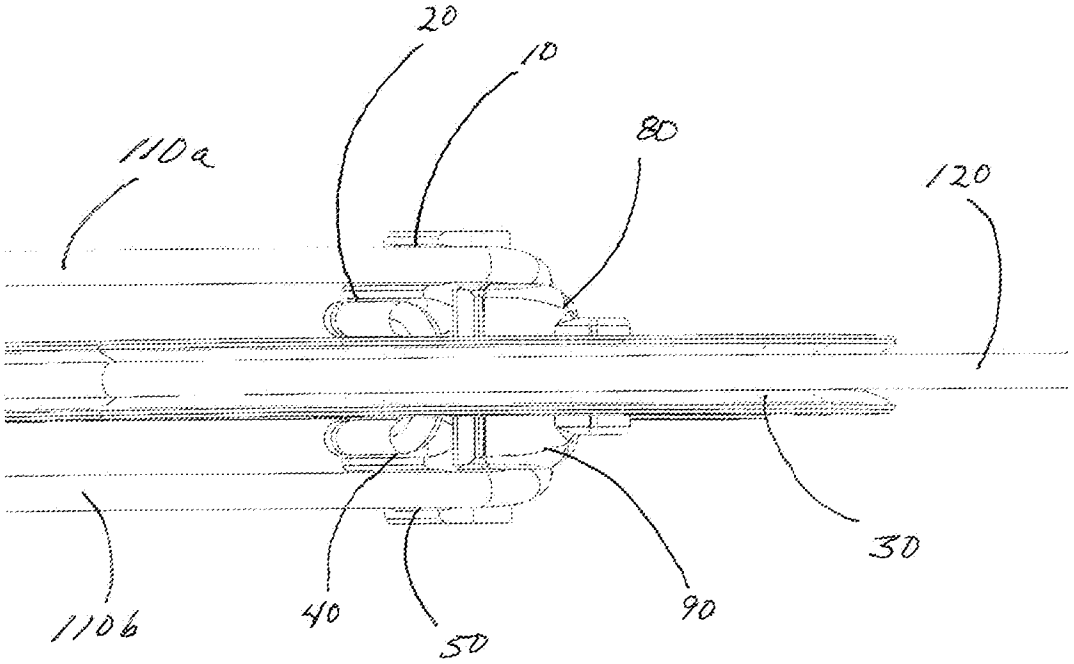
FIG. 15 is a perspective view of an embodiment of a cam having five parallel journals rotating on a common axis, with a ramp, and a power cable and bowstring in a partially drawn configuration wherein the cable segments have engaged with the first and fifth journals in accordance with the current disclosure.

Now referencing FIGS. 5 to 15, in a preferred embodiment, a first upper cable post 150 is located on or near P1, and a first lower cable post 160 is located on or near P5 on a first side of the longitudinal centerline of the crossbow, and a second upper cable post is located on or near P1, and a second lower cable post is located on or near P5 on a second side of the longitudinal centerline of the crossbow. As shown in FIGS. 8 and 9, segment 110*a* of cable 110 first engages C1-J2 on P2, and 110*b* of cable 110 first engages C1-J4 on P4. Terminal end 130 is higher than the at-rest departure point 140*a* of segment 110*a*, and terminal end 140 is lower than the at-rest departure point 140*b* of segment 110*b*, creating upward/downward pressure to change elevation as the cable segments wrap the cam. As the bowstring is drawn, the cams rotate and cable segments 110 and 110*b* wrap into J2/J4. Continued rotation of the cam engages the cable segments 110*a* and 110*b* with transition zone one 60 and transition zone two 70, and the upward/downward pressure transitions the cable segments into J1/J5 respectively.

C1-J2 is on plane P2 above the bowstring journal C1-J3, and C1-J1 is on plane P1 above C1-J2. Journal J2 may extend around the perimeter of the first cable first cable-path as little as 20 degrees of rotation and preferably no more than two hundred degrees of rotation. Cam 1 transition zone one 60 is adjacent the terminal end of C1-J2, and may extend around the perimeter of the first cable first cable-path as little as forty five degrees, and preferably no more than two hundred degrees of rotation. The terminal end of C1 transition zone one 60 is adjacent the leading edge of C1-J1. C1-J1 may extend around the perimeter of the first cable first cable-path as little as twenty degrees but preferably no more than two hundred degrees of rotation.

C1-J4 is on plane P4 below the bowstring journal C1-J3, and C1-J5 is on plane P5 below C1-J4; C1-J4 and C1-J5 are a mirror image about P3 of C1-J2 and C1-J1.

The first cable 110 cable-path one and cable-path two of Cam 1 are mirror images of each other about the plane of C1-J3. Each of the cable paths has three distinct segments: a first segment that is retained within a first flat journal 20 J2 and fourth flat journal 40 J4; a second segment that is not retained in any journal, but engages transition zones 60 and 70, and transitions the cable from P2/P4 to P1/P5; and a third segment that is retained in first flat journal 10 J1 and a fifth flat journal 50 J5.

An alternate embodiment would eliminate J1 and J2 (P1 and P2) making a three journal cam. In this embodiment, a first end of a cable attaches to a first cam and the second end of the cable attaches adjacent the center line of the crossbow, and a mirror image of this arrangement on the opposite side of the centerline of the crossbow. Yet another alternative would have the first end of the cable anchored to the first cam, and the second end of the cable anchored to the second cam.

The disclosure teaches preferred and alternate embodiments of the invention, however it does not disclose all potential embodiments. Alterations to the specific size, design, shape, mechanical properties, methods of manufacture, and so on shall not be limited to those outlined above, but shall be limited only by the scope of the claims. Additionally, the location of the cable ends and anchors may be at any position on the crossbow that will allow proper function of the crossbow.

We claim:

1. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis, the second cam C2 comprising a center draw string journal C2-J3, a first upper C2-J2 and a second upper C2-J1 segmented cable journals and a first lower C2-J4 and a second lower C2-J5 segmented cable journals, a centerline of each of said C2-J1, C2-J2, C2-J3, C2-J4 and C2-J5 segmented cable journals are parallel to each other, wherein C1 and C2 J2 and C1 and C2 J4 segmented cable journals and C1 and C2 J1 and C1 and C2 J5 segmented cable journals are non-continuous around a circumference of a first cam hub and a second cam hub;

a bow harness including a bow string and a first power cable and a second power cable, the bow string received in the center draw string journals and bow string ends secured to the first and second cams C1, C2; and the first and second power cables receivable in first and second cam cable journals, wherein as the bow string is being drawn from a released configuration to a drawn configuration, the bow string unwinds from C1-J3 and C2-J3 center draw string journals as simultaneously the first and second power cables wrap onto C1-J2/J4 and C2-J2/J4 segmented cable journals then exit said segmented cable journals the first and second power cables are received by and wrap onto C1-J1/J5 and C2-J1/J5 segmented cable journals.

2. The crossbow of claim 1, wherein:

first and second ends of the first power cable are fixed on a first side of a longitudinal centerline of the crossbow and first and second ends of the second power cable are fixed on a second side of the longitudinal centerline of the crossbow.

3. The crossbow of claim 1, wherein:

the first and second cams C1, C2 having one of an integrated ramp adjacent a transition zone or a coupled-component ramp adjacent the transition zone.

4. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis, the second cam C2 comprising a center draw string journal C2-J3, a first upper C2-J2 and a second upper C2-J1 segmented cable journals and a first lower C2-J4 and a second lower C2-J5 segmented cable journals, each journal have a plane of rotation and all journals parallel to each other, wherein C1 and C2 J2 and C1 and C2 J4 segmented cable journals and C1 and C2 J1 and C1 and C2 J5 segmented cable journals are non-continuous around a circumference of a first cam hub and a second cam hub; and a bow harness including a bow string and a first power cable and a second power cable, the bow string received in the center draw string journals and bow string ends secured to the first and second cams C1, C2, the first and second power cables receivable in first and second cam cable journals, wherein when the bow string is in a drawn configuration, the center draw string is unwound from C1-J3 and C2-J3 center draw cable journals, the power cables wrap C1-J2/J4 and C2-J2/J4 segmented cable journals, and at least partially wrap C1-J1/J5 and C2-J1/J5 segmented cable journals.

5. The crossbow of claim 4, wherein:

first and second ends of the first power cable are fixed on a first side of a longitudinal centerline of the crossbow and first and second ends of the second power cable are fixed on a second side of the longitudinal centerline of the crossbow.

6. The crossbow of claim 4, wherein:

the first and second cams C1, C2 having one of an integrated ramp adjacent a transition zone or a coupled-component ramp adjacent the transition zone.

7. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis, the second cam C2 comprising a center draw string journal C2-J3, a first upper C2-J2 and a second upper C2-J1 segmented cable journals and a first lower C2-J4 and a second lower C2-J5 segmented cable journals, each journal have a plane of rotation and all journals parallel to each other, wherein C1 and C2 J2 and C1 and C2 J4 segmented cable journals and C1 and C2 J1 and C1 and C2 J5 segmented cable journals are non-continuous around a circumference of a first cam hub and a second cam hub; and a bow harness including a bow string and a first power cable and a second power cable;

the bow string received in the center draw string journals and bow string ends secured to the first and second cams C1, C2; and the first and second power cables receivable in the first and second cam cable journals, wherein when the bow string is in a released configuration, the bow string is wound in the C1-J3 and C2-J3 center draw string journals, and the first and second power cables are adjacent C1-J2/J4 and C2-J2/J4 segmented cable journals.

8. The crossbow of claim 7, wherein:

first and second ends of the first power cable are fixed on a first side of a longitudinal centerline of the crossbow and first and second ends of the second power cable are fixed on a second side of the longitudinal centerline of the crossbow.

9. The crossbow of claim 7 wherein the first and second cams C1, C2 having one of an integrated ramp adjacent a transition zone or a coupled-component ramp adjacent the transition zone.

10. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis, the second cam C2 comprising a center draw string journal C2-J3, a first upper C2-J2 and a second upper C2-J1 segmented cable journals and a first lower C2-J4 and a second lower C2-J5 segmented cable journals, each journal have a plane of rotation and all journals parallel to each other, wherein C1 and C2 J2 and C1 and C2 J4 segmented cable journals and C1 and C2 J1 and C1 and C2 J5 segmented cable journals are non-continuous around a circumference of a first cam hub and a second cam hub; and a bow harness including a bow string and a first power cable and a second power cable, the bow string received in the center draw string journals and bow string ends secured to the first and second cams C1, C2, the first and second power cables receivable in the first and second cam cable journals, wherein as the bow string is being drawn from a released configuration to a drawn configuration, the bow string unwinds from C1-J3 and C2-J3 center draw string journals as simultaneously the power cables wrap onto C1-J2 and C2-J2 and C1-J4 and C2-J4 segmented cable journals then exit said journals, the first and second power cables are received by and wrap onto C1-J1, C2-J1, and C1-J1 and C2-J1 segmented cable journals.

11. The crossbow of claim 10 wherein:

first and second ends of the first power cable are fixed on a first side of a longitudinal centerline of the crossbow and first and second ends of the second power cable are fixed on a second side of the longitudinal centerline of the crossbow.

12. The crossbow of claim 10, wherein:

the first and second cams C1, C2 having one of an integrated ramp adjacent a transition zone or a coupled-component ramp adjacent the transition zone.

13. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis, the second cam C2 comprising a center draw string journal C2-J3, a first upper C2-J2 and a second upper C2-J1 segmented cable journals and a first lower C2-J4 and a second lower C2-J5 segmented cable journals, each journal have a plane of rotation and all journals parallel to each other, wherein C1 and C2 J2 and C1 and C2 J4 segmented cable journals and C1 and C2 J1 and C1 and C2 J5 segmented cable journals are non-continuous around a circumference of a first cam hub and a second cam hub; and a bow harness including a bow string and a first power cable and a second power cable, the bow string received in the center draw string journals and bow string ends secured to the first and second cams C1, C2, the power cables receivable in J2/J1 and J4/J5 cam cable journals, wherein when a bow is in a drawn configuration, the draw string is unwound from C1-J3 and C2-J3 center draw string journals, the power cables wrap C1-J2/J4 and C2-J2/J4 segmented cable journals, and at least partially wrap C1-J1/J5 and C2-J1/J5 segmented cable journals.

14. The crossbow of claim 13, wherein:

first and second ends of the first power cable are fixed on a first side of a longitudinal centerline of the crossbow and first and second ends of the second power cable are fixed on a second side of the longitudinal centerline of the crossbow.

15. The crossbow of claim 13, wherein:

the first and second cams C1, C2 having one of an integrated ramp adjacent a transition zone or a coupled-component ramp adjacent the transition zone.

16. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis, the second cam C2 comprising a center draw string journal C2-J3, a first upper C2-J2 and a second upper C2-J1 segmented cable journals and a first lower C2-J4 and a second lower C2-J5 segmented cable journals, each journal have a plane of rotation and all journals parallel to each other, wherein C1 and C2 J2 and C1 and C2 J4 segmented cable journals and C1 and C2 J1 and C1 and C2 J5 segmented cable journals are non-continuous around a circumference of a first cam hub and a second cam hub; and a bow harness including a bow string and a first power cable and a second power cable;

the bow string received in the center draw string journals and bow string ends secured to the first and second cams;

the power cables receivable in J2/J1 and J4/J5 cam cable journals, wherein when the bow string is in a released configuration, the bow string is wound in the C1-J3 and C2-J3 center draw string journals, and the power cables are adjacent C1-J2/J4 and C2-J2/J4 segmented cable journals.

17. The crossbow of claim 16, wherein:

first and second ends of the first power cable are fixed on a first side of a longitudinal centerline of the crossbow and first and second ends of the second power cable are fixed on a second side of the longitudinal centerline of the crossbow.

18. The crossbow of claim 16, wherein:

the first and second cams C1, C2 having one of an integrated ramp adjacent a transition zone or a coupled-component ramp adjacent the transition zone.

19. A crossbow comprising:

first and second flexible bow limbs coupled to a riser;

a first cam C1 coupled to the first bow limb and rotatable around a first axis, the first cam C1 comprising a center draw string journal C1-J3, a first upper C1-J2 and a second upper C1-J1 segmented cable journals and a first lower C1-J4 and a second lower C1-J5 segmented cable journals, a centerline of each of said C1-J1, C1-J2, C1-J3, C1-J4 and C1-J5 segmented cable journals are parallel to each other;

a second cam C2 coupled to the second bow limb and rotatable around a second axis; the second cam C2 comprising a center draw string journal C2-J3, a first upper C2-J2 and a second upper C2-J1 segmented cable journals and a first lower C2-J4 and a second lower C2-J5 segmented cable journals, a centerline of each of said C2-J1, C2-J2, C2-J3, C2-J4 and C2-J5 segmented cable journals are parallel to each other; and a bow harness including a bow string and a cable; the bow string received in the center draw string journals and bow string ends secured to the first and second cams C1, C2, a first power cable and a second power cable receivable in first and second cam segmented cable journals, wherein as the bow string is being drawn from a released configuration to a drawn configuration, the bow string unwinds from C1-J3 and C2-J3 center draw string journals as simultaneously power cable segments wrap onto C1-J2/J4 and C2-J2/J4 segmented cable journals then exit said journals, the first and a second power cables are received by and wrap onto C1-J1/J5 and C2-J1/J5 segmented cable journals, wherein C1 and C2 J2 and C1 and C2 J4 segmented cable journals and C1 and C2 J1 and C1 and C2 J5 segmented cable journals are non-continuous around a circumference of a first cam hub and a second cam hub.

20. The crossbow of claim 19, wherein:

first and second ends of the first power cable are fixed on a first side of a longitudinal centerline of the crossbow and first and second ends of the second power cable is are fixed on a second side of the longitudinal centerline of the crossbow.

21. The crossbow of claim 19, wherein:

the first and second cams C1, C2 having one of an integrated ramp adjacent a transition zone or a coupled-component ramp adjacent the transition zone.

22. The crossbow of claim 19 wherein:

a routing path of each one of the first and second power cables may be described as: a first end anchored on a first side of a longitudinal centerline of the crossbow; a segment of each one of the first and second power cables passes through the first cam C1; a span of each one of the first and second power cables crosses the centerline of the crossbow to the second cam C2; a segment of each one of the first and second power cables goes through the second cam C2; a second end anchored on a second side of the longitudinal centerline of the crossbow.

23. A cam for a projectile launching device, comprising:

a cam body, a cam axis, the cam body having five stacked planar journals and two transition zones, first and second cable journals C1-J1, C1-J2 are located above a center string journal C1-J3, and fourth and fifth cable journals C1-J4, C1-J5 are located below the center string journal, wherein the fourth and fifth cable journals C1-J4, C1-J5 are a mirror image of the first and second cable journals C1-J1, C1-J2, the center string journal C1-J3 is capable of receiving a bowstring;

the cable journal C1-J4 is on a plane below the center string journal C1-J3, and the fifth cable journal C1-J5 is on a plane below the fourth cable journal C1-J4, fourth and fifth cable journals C1-J4 and C1-J5 are a mirror image of first and second cable journals C1-J2 and C1-J1; and fourth cable journal J4 may extend around a perimeter of a first cable second cable-path with at least 20 degrees of rotation and no greater than two hundred degrees of rotation;

a C1 transition zone two is adjacent a terminal end of fourth cable journal C1-J4, and may extend around a perimeter of the first cable second cable-path with at least 45 degrees, and no greater than two hundred degrees of rotation;

a terminal end of the C1 transition zone two is adjacent a leading edge of the fifth cable journal C1-J5; and C1-J5 may extend around the perimeter of the first cable second cable-path as little as twenty degrees but no more than two hundred degrees of rotation, wherein cable journals C1-J1, C1-J2, C1-J4, C1-J5 are capable of receiving a power cable, C1 and C2 J2 and C1 and C2 J4 segmented cable journals and C1 and C2 J1 and C1 and C2 J5 segmented cable journals are non-continuous around a circumference of a first cam hub and a second cam hub.

* * * * *